US009689179B2

(12) United States Patent
Fan et al.

(10) Patent No.: US 9,689,179 B2
(45) Date of Patent: Jun. 27, 2017

(54) PADLOCK HAVING A BLOCKING PLATE FOR A SPRING-BIASED LOCKING ELEMENT

(75) Inventors: Wai Kuen Fan, Tseung Kwan O (HK); Bernhard Garthe, Gevelsberg (DE)

(73) Assignee: ABUS AUGUST BREMICKER SOHNE KG, Wetter-Volmarstein (DE)

( * ) Notice: Subject to any disclaimer, the term of this patent is extended or adjusted under 35 U.S.C. 154(b) by 1846 days.

(21) Appl. No.: 12/788,700

(22) Filed: May 27, 2010

(65) Prior Publication Data

US 2010/0300165 A1 Dec. 2, 2010

(30) Foreign Application Priority Data

Jun. 2, 2009 (DE) ..... 10 2009 023 561

(51) Int. Cl.

*E05B 67/24* (2006.01)
*E05B 67/22* (2006.01)
*E05B 67/00* (2006.01)

(52) U.S. Cl.

CPC ..... *E05B 67/22* (2013.01); *E05B 67/00* (2013.01); *E05B 67/24* (2013.01); *Y10T 70/452* (2015.04); *Y10T 70/8432* (2015.04)

(58) Field of Classification Search

USPC ..... 70/20, 31, 35, 38 A, 39, 51–53
See application file for complete search history.

(56) References Cited

U.S. PATENT DOCUMENTS 4,998,422 A * 3/1991 Borgmann et al. ..... 70/38 A
5,174,136 A * 12/1992 Thwing ..... 70/38 A
5,363,678 A 11/1994 Meckbach
5,377,511 A 1/1995 Meckbach
6,145,356 A * 11/2000 Thwing ..... 70/389
6,813,913 B2 11/2004 Watts
(Continued)

FOREIGN PATENT DOCUMENTS

DE 4323693 A1 1/1995
GB 2277121 A 10/1994
(Continued)

OTHER PUBLICATIONS

German Search Report for German Patent Application No. 10 2009 023 561.2, dated Mar. 30, 2010, and English translation thereof.
(Continued)

*Primary Examiner* — Christopher Boswell

(57) ABSTRACT

A padlock including a lock body, a shackle having two shanks with grooves for receipt of respective locking elements, and a pin which can be rotated by a lock cylinder core for moving the locking elements into their locking position. The pin has an engagement element configured to cooperate with an entrainer formation on the lock cylinder core. The padlock also includes a blocking plate located between the pin and the lock cylinder core and which is fastened in the lock body. The blocking plate has an opening through which the entrainer formation projects into the plane of the engagement element. The opening is configured such that, on the one hand, rotational movement of the lock cylinder core is possible and, on the other hand, a marginal region of the opening forms an abutment engageable with the entrainer formation for restricting rotational movement of the lock cylinder core.

19 Claims, 8 Drawing Sheets

(56) References Cited

U.S. PATENT DOCUMENTS

| | | | | |
|---|---|---|---|---|
| 7,036,344 | B2 * | 5/2006 | Gast et al. | 70/38 A |
| 7,278,283 | B2 * | 10/2007 | Meckbach | 70/38 R |
| 2002/0078720 | A1 * | 6/2002 | Watts | 70/38 A |
| 2003/0041630 | A1 | 3/2003 | Laitala et al. | |
| 2005/0061040 | A1 * | 3/2005 | Gast et al. | 70/38 A |
| 2007/0204664 | A1 * | 9/2007 | Tang | 70/38 A |

FOREIGN PATENT DOCUMENTS

| | | | |
|---|---|---|---|
| WO | 2005/106168 | A1 | 11/2005 |
| WO | 2007/019639 | A1 | 2/2007 |

OTHER PUBLICATIONS

European Search Report for Application No. 10 005 359.4 dated Sep. 25, 2014; 3 Pages.
Translation of European Search Report for Application No. 10 005 359.4 dated Sep. 25, 2014; 4 Pages.

* cited by examiner

PADLOCK HAVING A BLOCKING PLATE FOR A SPRING-BIASED LOCKING ELEMENT

CROSS-REFERENCE TO RELATED APPLICATIONS

This application claims the benefit of German Patent Application No. 10 2009 023 561.2, filed Jun. 2, 2009. The disclosure of the above application is incorporated herein by reference in its entirety.

FIELD

The invention relates to a padlock having a blocking plate for a spring-biased locking element. More specifically, the padlock includes a lock body, a shackle having grooves for receipt of a respective part of locking elements, a pin having an engagement element which can be acted on by a entrainer member formed on a lock cylinder core for moving the locking elements into a locking position, a spring for biasing the pin into its locking position, and a blocking plate located in the lock body between the pin and the lock cylinder core.

BACKGROUND

Padlocks are known, for example, from the U.S. Pat. Nos. 5,377,511 and 5,363,678 which are commonly-owned by the applicant. As such the contents of these particular US patents are herewith included in their entirety into the disclosure of the present invention.

A padlock in accordance with U.S. Pat. No. 5,377,511 is characterized in that the shackle can be removed completely from the lock body in a simple manner and can be replaced by another shackle. It is thus possible with such a padlock to change the length of the shackle, its shape and/or its material by such a replacement.

This shackle replacement feature is made possible in that the pin, made as a ball pin, has an additional groove whose depth has a larger dimension than the depth of its two other grooves. These two other grooves only enable movement of the locking elements, made as locking balls, into such a position in which the padlock can be opened, but the shackle cannot be completely removed from the lock body. However, engagement of one of the locking balls into the additional, deeper groove makes it possible with an open padlock that the shackle can be moved out of the lock body and can be replaced by another shackle. To cause the locking ball to engage this additional groove, it is necessary to "overrotate" the ball pin in the opening direction. Such an overrotating can be effected by means of a simple screwdriver after the lock cylinder has been removed from the lock body and the ball pin has thus been made freely accessible.

The possibility of overrotating the ball pin may, however, naturally not be given with an inserted lock cylinder since the ball pin could otherwise also be overrotated in normal practical use in a manner such that the shackle is released from the lock body. To prevent such an overrotating of the ball pin in normal practical operation, a special lock cylinder is used in the padlock disclosed in U.S. Pat. No. 5,377,511 which has an abutment element configured to restrict rotational movement of the lock cylinder core. Since such rotational movement of the lock cylinder core is only possible with restrictions, the ball pin can also only be rotated between its normal open and closed positions by means of the lock cylinder core, with over-rotation of the ball pin being prevented by the abutment element on the lock cylinder. Such an overrotating is only possible when the lock cylinder had previously been removed from the lock body.

One possible disadvantage with a padlock in accordance with U.S. Pat. No. 5,377,511 is that, upon removal of the lock cylinder from the lock body, the ball pin and possibly also the spring biasing the ball pin may unintentionally fall out of the lock body so that it is difficult for the user of the padlock who has not had special training to put the named parts back together again correctly. The insertion of the spring back into the lock body in particular may cause problems.

Another possible disadvantage is that only lock cylinders with an abutment feature can be used so that a replacement of lock cylinders is only possible with restrictions.

Padlocks similar to that disclosed in U.S. Pat. No. 5,377,511 typically have lock cylinders which are designed such that a key with which the cylinder core in the lock cylinder can be rotated can only be withdrawn from the lock cylinder in a single, defined angular position (withdrawal position) of the key. In this respect, a distinction is made between the following two types of padlocks.

In padlocks with "forced locking", the key can only be rotated into its withdrawal position and withdrawn from the lock cylinder when the padlock is in its closed position, that is when both shanks of the shackle are locked in the lock body. If therefore no key is inserted into the lock cylinder of such a padlock, it can definitely be assumed that the padlock is in its closed state.

Padlocks with an "automatic operation", in contrast, also allow rotation of the key to its withdrawal position and withdrawal of the key from the lock cylinder when the padlock is open, that is when the shanks of the shackle are not locked in the lock body. With such padlocks, withdrawal of the key from the lock cylinder is therefore possible, on the one hand, when the padlock is open and, on the other hand, when the padlock is locked.

Padlocks with an automatic operation are furthermore characterized in that they can be locked without a key present in the lock cylinder in that the shackle is very simply pushed into the lock body. Due to the previously mentioned bias applied to the ball pin, it is moved into its locked position subsequent to such a shackle movement so that the shackle moved into the lock body is also locked therein by its two shanks.

To enable the potential use of padlocks which are as versatile as possible, it is known to provide padlocks which can be selectively used with either forced locking or an automatic operation. Such a padlock is described in the already named and commonly-owned U.S. Pat. No. 5,363,678.

It is important in such a padlock that there is "play" between an engagement element of the pin, also made as a ball pin in this case, and an entrainer formation on the cylinder core which allows a rotation of the cylinder core through a specific angle, which can amount to approximately 60 degrees for example, without the ball pin also rotating. It is achieved by this play that the ball pin can also remain in its open position without locking the shackle in the lock body with an open padlock when the key is rotated into its withdrawal position and is subsequently removed from the lock cylinder. Only a movement of the shackle into the lock body then causes the ball pin to move into its locked position due to the mentioned bias, in which the locking elements, also made as locking balls here, lock the shackle with its two shanks in the lock body.

By insertion of a bridge member into the region between the engagement element on the ball pin and the entrainer formation on the lock cylinder core, the named play can be eliminated as required so that a rotational movement of the lock cylinder core is only possible in concert with a rotational movement of the ball pin. In padlocks with an inserted bridge member, the key can accordingly only be rotated into its withdrawal position and be withdrawn from the lock cylinder when the shackle is in the lock body and its two shanks are locked via the locking balls. If desired, it is possible to remove the bridge member from the padlock so that the named play is again present between the engagement element and the entrainer formation. It is thus possible by the selective insertion or removal of the bridge member to switch padlocks of the type shown in U.S. Pat. No. 5,363,678 between forced locking and automatic operation.

With a padlock known from U.S. Pat. No. 5,363,678, the bridge member can be removed after the lock cylinder has been removed from the lock body. After removal of the lock body, the bridge member is still typically located in the region of the engagement element on the ball pin, with it frequently occurring that the bridge member adheres to the end face of the ball pin due to adhesive forces which are, for example, amplified by the presence of lubricants so that the bridge member cannot be released from the ball pin simply due to gravity. In these cases, it is frequently attempted to release the bridge member from the ball pin by means of a screwdriver or by pounding the padlock against a hard surface in order to remove it from the padlock. However, this contains the risk that not only the bridge member, but also the ball pin and where applicable the biasing spring are unintentionally released from the lock body. As already mentioned, this is undesirable since the spring can only be inserted again with a relatively large effort, in some cases only by specially trained personnel using special tools.

It is therefore generally problematic in padlocks of the type known in the prior art that, upon release of the lock cylinder from the lock body, the ball pin and/or the biasing spring can unintentionally fall out of the lock body. In this respect, the requirement to release the lock cylinder from the lock body can, for example, be due to the fact that the lock cylinder has to be replaced, that the shackle of the padlock has to be replaced or that the padlock has to be converted between forced locking and an automatic operation.

SUMMARY

It is an object of the invention to provide a padlock which improves upon the prior art in that, upon the removal of the lock cylinder from the lock body, the pin and optionally also the spring biasing the pin are prevented from being unintentionally released from the lock body. Moreover, the padlock in accordance with the invention also enables the use of lock cylinders without the abutment feature explained above in connection with the padlock disclosed in U.S. Pat. No. 5,377,511 for enabling shackle replacement.

These and other objects are satisfied in accordance with the invention in that a blocking plate is provided in the padlock which is fastened between the pin and the lock cylinder core within the lock body. The blocking plate has an opening through which the entrainer formation on the lock cylinder core projects into the plane of the engagement element on the pin. In this respect, the opening is designed such that, on the one hand, a rotational movement of the lock cylinder core is possible and, on the other hand, a marginal region of the opening forms an abutment engageable with the entrainer formation of the lock cylinder core for restricting rotational movement of the lock cylinder core.

The entrainer formation on the lock cylinder core can be connected to it fixedly and non-releasably or also in a releasable form. A screw connection is conceivable, but also only an insertion into a groove at the side of the cylinder lock core or a one-piece formation of the entrainer formation and of the lock cylinder core are also contemplated.

In accordance with the invention, retention of the pin and optionally of the spring biasing the pin in the direction of the axis of the lock cylinder core is consequently achieved by securing the blocking plate within the lock body so that the blocking plate reliably counteracts an unintended falling out of the pin and/or the spring. Since ultimately an operational connection has to be able to be manufactured between the lock cylinder core and the pin to be able to transmit rotational movement of the lock cylinder core to the pin, the blocking plate cannot be made closed. As such, the opening is provided in the blocking plate in accordance with the invention through which parts of the lock cylinder core, in particular its entrainer formation, can project in order to establish the named operational connection.

In accordance with the invention, this opening in the blocking plate is designed such that it enables a maximum number of different use possibilities of a padlock in accordance with the invention. In particular, since the opening in the blocking plate forms an abutment for the entrainer formation present with virtually all conventional lock cylinders, it is not necessary to use special lock cylinders having a separate abutment feature in padlocks which are capable of shackle replacement. Perfectly normal lock cylinders can rather be used whose entrainer formations, which are fastened releasably or non-releasably to the cylinder core, can abut the marginal region of the opening in the blocking plate formed in accordance with the invention and thus restrict the rotational movement of the lock cylinder core. Since the blocking plate in accordance with the invention does not restrict the rotational movement of the pin in any way, an overrotating of the pin for the purpose of replacement of the shackle is still possible. The principles of the present invention can thus advantageously be used in padlocks in accordance with U.S. Pat. No. 5,377,511 to enable a shackle replacement as well as in padlocks in accordance with U.S. Pat. No. 5,363,678 to permit switching between automatic operation and forced locking, since neither the pin nor the spring can unintentionally fall out of the padlock. It is also possible to install or remove the bridge member required with such padlocks through the opening in the blocking plate.

The invention can thus be used in padlocks which simultaneously permit both a replacement of the shackle and a switching between an automatic operation and forced locking, as well as in padlocks which either only permit a replacement of the shackle or only a switch between an automatic operation and forced locking.

The blocking plate provided in accordance with the invention is fastened in such a stable manner between the pin and the lock cylinder core, or optionally between the spring and the lock cylinder core, so as to prevent relative movement with respect to the lock body due to a screwdriver used with normal forces or due to hammering of the padlock onto a hard surface so that it reliably counteracts any movement of the spring optionally associated with the pin or of the pin itself out of the lock body. The blocking plate does not mechanically separate the pin and the lock cylinder and in particular the engagement element of the pin and the entrainer formation of the lock cylinder core from one another since—as already mentioned—the engagement element and entrainer formation have to be able to move into engagement with one another for the transmission of a rotational movement from the lock cylinder core to the pin. The blocking plate in accordance with the invention accordingly has the already explained opening through which the entrainer formation on the lock cylinder core can project into the plane of the engagement element on the pin. The opening in the blocking plate in this respect has to be dimensioned such that a rotational movement of the lock cylinder core is still possible, which specifically means that the movement of the entrainer formation or entrainer formations on the lock cylinder core may not be impeded at least over a specific rotational angular range of motion of the lock cylinder core. It is preferred if the opening of the blocking plate allows rotation of the lock cylinder core through approximately 60°.

Since a spiral spring is usually used as the spring for biasing the pin, it is of advantage if the opening in the blocking plate is arranged relatively central therein so that the blocking plate has an annular region which surrounds the opening and can support the spiral spring, whereby movement of the spiral spring out of the lock body is prevented by this annular region.

The blocking plate is preferably made such that a first marginal region of its opening forms an abutment for the entrainer formation on the lock cylinder core which restricts rotational movement of the lock cylinder core into its open position. In this case, the blocking plate provides an additional function, in addition to retaining the spring associated with the pin, of restricting rotational movement of the lock cylinder into its open position. Since the blocking plate is preferably produced from a comparatively stable material, in particular from metal, and is fixedly and immovably attached in the lock body, a particular stable abutment is realized which cannot easily be damaged or bent, for example, by a manual overrotating of a key introduced into the lock cylinder.

It is furthermore advantageous if the lock cylinder core has a first entrainer formation and a second entrainer formation which are arranged off-center on the end face of the lock cylinder core facing the pin and which are oppositely disposed with respect to the axis of rotation of the lock cylinder core. It is preferred that the first entrainer formation and the second entrainer formation of the lock cylinder core each have a substantially rectangular cross-section.

On the provision of providing two entrainer formations on the lock cylinder core, the first marginal region of the opening in the blocking plate can form a first abutment engageable with the first entrainer formation for restricting rotational movement of the lock cylinder core into its open position. In addition, a second marginal region of the opening in the blocking plate can form a second abutment engageable with the second entrainer formation for restricting rotational movement of the lock cylinder core into its locked position. Thus, the blocking plate in accordance with the invention can function to restrict movement of the lock cylinder core into its two, mutually opposite directions of rotation and in this connection forms particularly stable abutments.

The pin can have a first engagement element and a second engagement element which are arranged off-center on the end face of the pin facing the lock cylinder core and which are oppositely disposed with respect to the axis of rotation of the pin. The first engagement element and the second engagement element can in this respect each have a substantially quadrant-shaped cross-section.

The blocking plate provided in accordance with the invention preferably substantially has a circular shape whose diameter generally corresponds to the diameter of that region of a lock cylinder which includes the cylinder core. It is of advantage if the blocking plate has elevated portions and recesses in an alternating fashion at least in a part region of its outer periphery so that it can be introduced into the lock body and can be pressed therein with a slight deformation of the elevated portions under the effect of force. A pressing of the blocking plate in the lock body is, however, alternatively also possible without elevated portions and recesses being formed at the outer periphery of the blocking plate. In this case, the blocking plate must then be produced with a slight excess dimension to enable the pressing.

It is also advantageous if the blocking plate has a security against rotation projection extending beyond its periphery. Since the opening of the blocking plate is not rotationally symmetrical to its center due to the abutment function in accordance with the invention, it namely has to be ensured that the blocking plate fastened in the lock body cannot rotate.

The opening of the blocking plate can approximately have a part-circle shape, with the part circle including an angle between 180° and 300°, and in particular an angle of approximately 240°. At an angle of 240°, a rotation of the lock cylinder core by approximately 60° is made possible.

It is particularly preferred for padlocks in which replacement of the shackle is possible if the pin is arranged completely outside the plane of the blocking plate in accordance with the invention and has at its jacket surface, in addition to two mutually oppositely disposed grooves, an additional groove which is deeper than the two mutually oppositely disposed grooves. The two mutually oppositely disposed grooves move into engagement with both locking elements on a normal opening of the padlock so that the locking elements can move radially inwardly with respect to the axis of the cylinder core and thus release the two shanks of the shackle so that the padlock can be opened. It is, however, not possible in this position to release the shackle from the lock body since the axial movement of the region of the longer shank of the shackle located in the lock body is restricted by suitable measures. If now, however, the pin is overrotated in the direction of opening such that the locking element associated with the longer shank comes into operational connection with the additional deeper groove, the corresponding locking element can move radially still further in the direction of the axis of the cylinder core so that the longer shank of the shackle is completely released in this manner, which has the consequence that the shackle can be released from the lock body.

It is particularly preferred with a padlock in accordance with the last-described variant that the longer shank of the shackle have a restriction in its end region facing the lock body. This restriction in this respect comes into contact with a locking element in the normal open position of the padlock and thus restricts the axial movement of the longer shank of the shackle such that it cannot be moved completely out of the lock body. Only when the named locking element moves into the deeper groove of the pin is the named restriction released so that a replacement of the shackle becomes possible.

In accordance with the invention, a tool is also provided which can be used to effect a replacement of the shackle in the last-described padlock variant. Such a tool has a T shape in its front end region, with the length of the transverse shank of the T shape being dimensioned such that this transverse shank is movable through the opening of the blocking plate in accordance with the invention. The transverse shank is furthermore at least so long that it can come simultaneously into contact with both engagement elements of the pin. The dimensions of the transverse shank in the direction of the axis of rotation of the cylinder core in this respect correspond at a maximum to the spacing between the blocking plate and the surface of the pin facing the blocking plate to which its engagement elements are attached. These dimensions preferably approximately correspond to the height of at least one of the engagement elements of the pin. If the front end region of the tool was moved through the opening of the blocking plate after the removal of the lock cylinder, the two mutually remote outer end regions of the transverse shank can engage the engagement elements on the pin so that an overrotation of the pin can be effected by a rotational movement of the tool such that the locking element associated with the longer shank is located in the region of the deeper groove on the pin. The shackle can then be removed from the lock body in this position of the locking element. Such rotational movement of the tool becomes possible in that the connection section between the transverse shank and the remaining tool region is dimensioned so small that this connection section is rotatable within the opening of the blocking plate.

It is preferred in this respect if a cylindrical region whose diameter is dimensioned somewhat larger than the diameter of the cylinder core adjoins the front end region of the tool or the last-named connection region. In this manner, the tool is guided particularly easily in the lock body on its rotational movement, which enables a smooth rotational movement of the pin by means of the tool. However, instead of a cylindrical region, a section with considerably smaller dimensions can also be provided in a less expensive version between the front end region of the tool and its handling region, said section then not ensuring the named guidance. In this case, the tool can be made as a simple stamped part.

A further preferred embodiment of the invention which enables a switching between automatic operation and forced locking is designed so that a core play is present between the engagement elements of the pin and the entrainer formations of the lock cylinder, with such core play allowing a rotation of the lock cylinder core by a specific angle without the pin co-rotating. This play enables the realization of a padlock with an automatic operation since the lock cylinder core can be rotated into a position in which removal of the key is possible without the pin co-rotating with an open padlock. Furthermore, a bridge member substantially eliminating this play can selectively be inserted between the engagement elements and the entrainer formations, with this bridge member being able to be inserted through the opening of the blocking plate into the plane of the engagement elements of the pin. A switching of the operating mode from automatic operation to forced locking takes place by insertion of this bridge member since, due to the bridge member, the lock cylinder core can only be rotated together with the pin.

In this respect, it is an important feature of the present invention that the shape of the opening in the blocking plate be designed so that the bridge member can be moved without problem through this opening. As a rule, the outline of the bridge member will therefore be smaller in a plane extending perpendicular to the axis of rotation of the pin than the surface of the opening in the blocking plate. In this case, the bridge member can then be moved through the opening of the blocking plate without it being rotated and without any "threading".

The bridge member preferably has a Z shape with a center part and two shanks projecting therefrom at an angle, in particular at a right angle. In this respect, the marginal regions of the shanks disposed at the outside with respect to the center part can have the shape of an arc of a circle, with the radius of the arcs being smaller than the radius of the part-circle opening formed in the blocking plate. The center part can furthermore have a chamfer in the region of only one of the two shanks, with the chamfer being provided on the side of the center part remote from the respective shank.

Further areas of applicability will become apparent from the detailed description provided herein. It should be understood that the description and specific examples are intended for purposes of illustration only and are not intended to limit the scope of the claims.

DRAWINGS

The invention will be explained in the following by way of example with reference to the drawings; there are shown in these:

DETAILED DESCRIPTION

The following description is merely exemplary in nature and is not intended to limit the present invention and its applications and/or uses.

Figure 1:
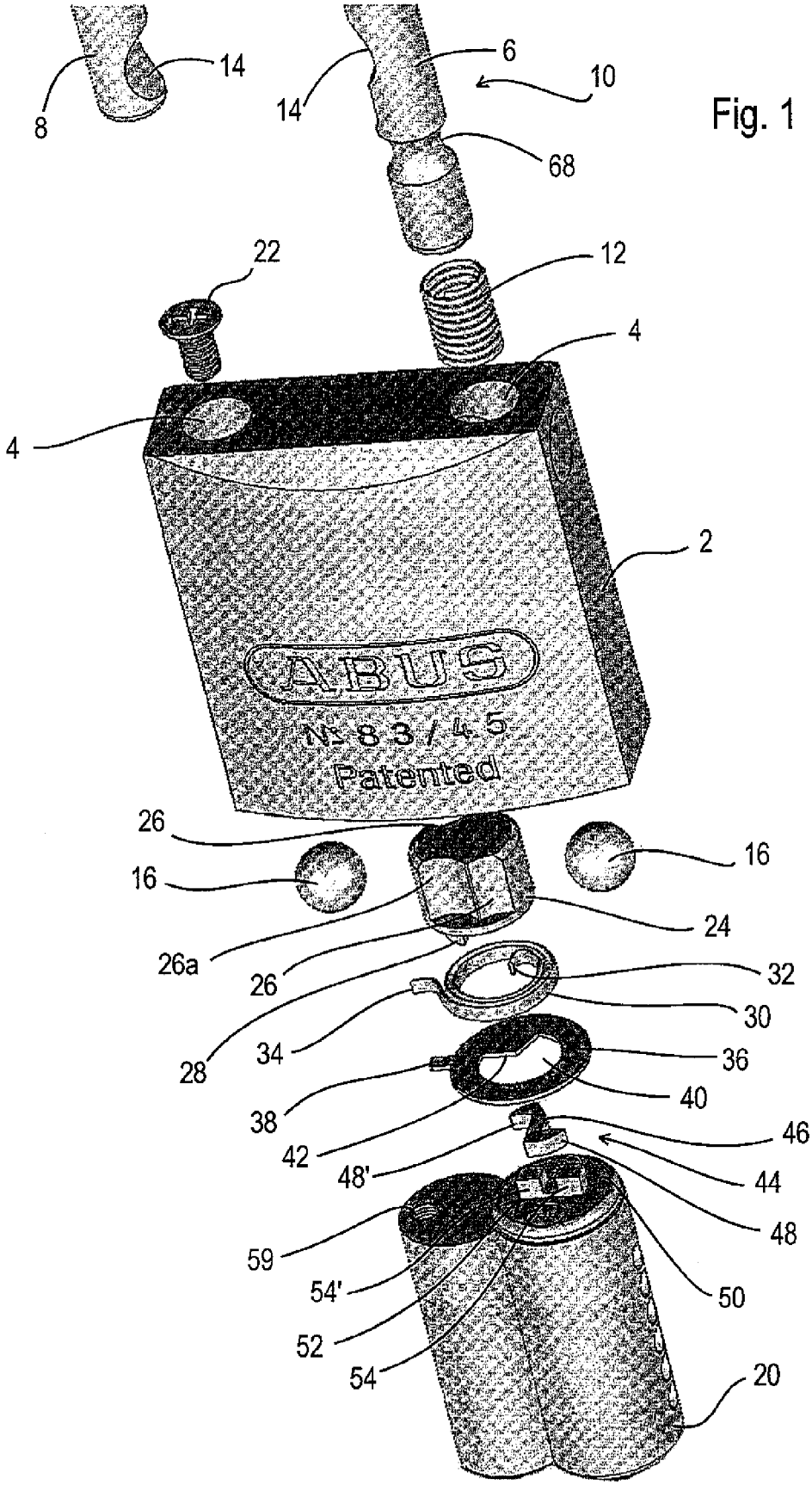
FIG. 1 is an exploded drawing of a padlock in accordance with the invention viewed obliquely from above.
Figure 2:
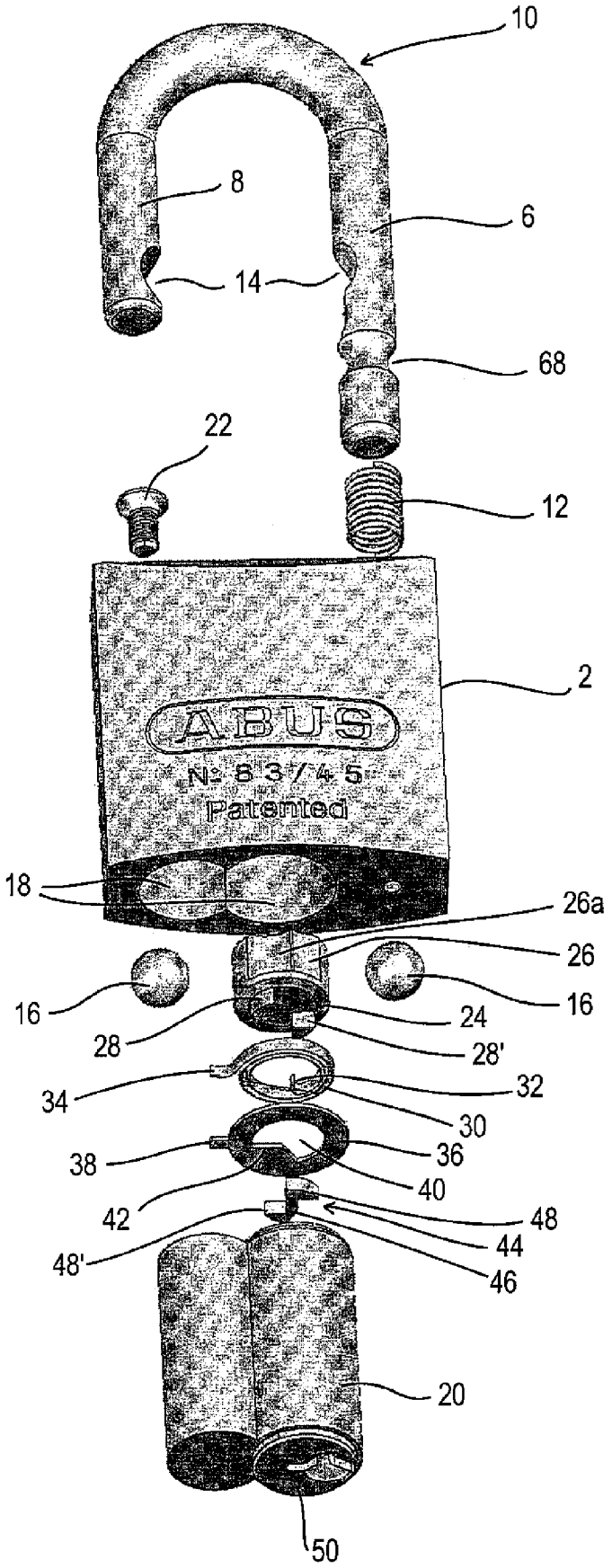
FIG. 2 is a drawing of the padlock in accordance with FIG. 1 viewed obliquely from below.

FIGS. 1 and 2 show a padlock having a lock body 2 which has two bores 4 at its upper end face into which two shanks 6, 8 of a shackle 10 can be introduced. The shank 6 is in this respect longer than the shank 8 and, when it is in the lock body 2, is biased by a compression spring 12 which moves the shackle 10 axially into its unlocked open position if it is not held back by other forces.

Both shanks 6, 8 of the shackle 10 each have a groove 14 at the same height formed in their inner side and into which a respective part region of a locking element, shown herein as a locking ball 16, engages in the locked state of the padlock. Instead of locking balls 16, locking elements shaped in any other suitable manner can also alternatively be used. The longer shank 6 furthermore has a restriction 68 between its end at the lock body side and its groove 14, with the restriction preferably extending over the total periphery of the shank 6. Alternatively, it would also be possible here only to provide a notch or groove on the side of the longer shank 6 facing the locking ball 16. Such a notch or groove would then not extend over the total periphery of the shank 6.

At its lower end face and disposed opposite the bores 4, the lock body 2 has two mutually overlapping bores 18 which are dimensioned such that a lock cylinder 20 can be introduced into them from below. This lock cylinder 20 can be fastened in a usual manner in the lock body 2 by means of a screw 22 with an open shackle 10.

Upon the assembly of a padlock in accordance with FIGS. 1 and 2 ex works, the following describes a preferred order that the parts are first introduced into the lock body 2 via the bores 18 before introduction of the lock cylinder 20.

After the locking balls 16 have been inserted into the lock body 2, a lock pin, shown herein as a ball pin 24, is inserted which substantially has a cylindrical shape and has, at its outer periphery, two mutually oppositely disposed grooves 26 which form a control gate for the locking balls 16 in the usual manner. Upon rotation of the ball pin 24 about its center axis, the named control gate is able to move the locking balls 16 between their locking position into the grooves 14 of the shackle 10 and their releasing position out of the grooves 14.

The ball pin 24 furthermore also has an additional groove 26*a* at its outer periphery whose radial depth is dimensioned larger than that of the mutually oppositely disposed grooves 26. The operation of the additional groove 26*a* will be explained hereinafter.

At its lower side, the ball pin 24 has two originally-extending engagement elements 28, 28' which are quadrant-shaped in cross-section and which are arranged symmetrical to the central axis of rotation of the ball pin 24.

After insertion of the ball pin 24 into the bores 18, a spiral spring 30 is inserted such that its inwardly projecting prolongation 32 is supported at the engagement element 28' and its outwardly projecting prolongation 34 is fixed in the lock body 2 in a suitable manner to inhibit movement relative to the lock body 2. A rotational movement of the ball pin 24 in a clockwise movement (with respect to FIG. 2) consequently produces an entrainment of the prolongation 32 by the engagement element 28' and thus causes a tensioning of the spiral spring 30.

After insertion of the spiral spring 30, a blocking plate 36 in accordance with the invention is introduced into the openings 18 and is pressed therein so that it can no longer move relative to the lock body 2. The pressing takes place in this respect at a position in which a tensioning or relaxation of the spiral spring 30 is not impeded by friction. The blocking plate 36 has a security against rotation projection or tab 38 which protrudes radially beyond its periphery and which reliably prevents rotation of the blocking plate 36 about the axis of rotation of the ball pin 24 when the blocking plate 36 is pressed into the lock body 2. The blocking plate 36 furthermore has a central opening 40 which approximately has the shape of a part circle, with the part circle including an angle of approximately 240°. A region 42 of the blocking plate 36 which is not associated with the opening 40 and which would complement the opening 40 to form a full circle accordingly approximately includes an angle of 120°, with the tip of this region 42 being disposed somewhat outside the center of the opening 40 in the radial direction so that the opening 40 does not form an exact part circle, but is rather made somewhat larger than such an exact part circle.

After insertion of the blocking plate 36, a bridge member 44 can be inserted as required through the opening 40 in the blocking plate 36 in the manner explained below and ultimately comes to lie between the engagement elements 28 and 28'. The bridge member 44 substantially has a Z shape with a center part 46 and two shanks 48, 48' projecting therefrom at right angles.

As required, the bridge member 44 is typically first coupled with the lock cylinder 20 and then inserted into the lock body 2 together with it. A rotatable cylinder core 50 of the lock cylinder 20 has, at its end face facing the ball pin 24, a substantially U-shaped entrainment member 52 which defines two entrainer formations 54, 54" that project axially in the direction of the ball pin 24 (see FIG. 1). The two entrainer formations 54, 54' have a substantially square cross-section and define a gap between them in which the center part 46 of the bridge member 44 can be received so that in this case the bridge member 44 rotates together with entrainer formations 54, 54' after insertion of the lock cylinder 20 upon rotational movement of the cylinder core 50.

After the insertion of the lock cylinder 20, it is fixed in the lock body 2 by means of the screw 22, whereupon the padlock is completely assembled. As required, the lock cylinder 20 can be easily removed from the lock body 2 again by loosening the screw 22 in the unlocked position of the padlock. An optionally inserted bridge member 44 can then likewise be removed to convert the padlock from forced locking to an automatic operation. The lock cylinder 20 can equally naturally also be removed to insert a bridge member 44, not previously present, through the opening 40 in the blocking plate 36 in order to carry out a conversion of the padlock from an automatic operation to forced locking. On such conversion processes, the spiral spring 30 and also the ball pin 24 cannot fall out of the lock body 2 since they are retained therein by the blocking plate 36 in accordance with the invention.

Figure 3:
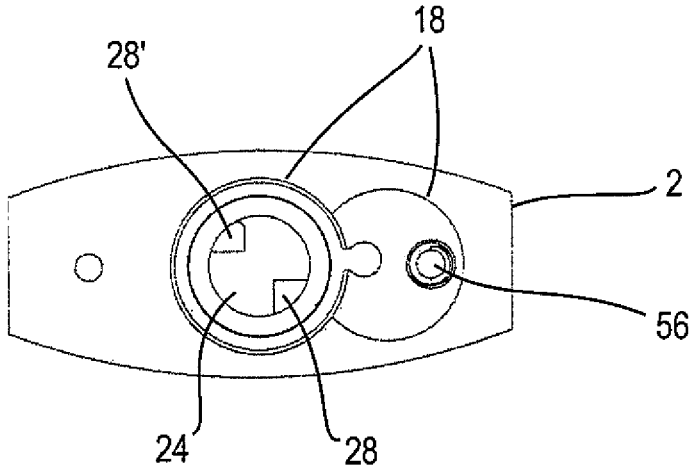
FIG. 3 is a bottom view of a lock body associated with the padlock shown in FIGS. 1 and 2 without a lock cylinder, a bridge member, a blocking plate or a spring.

FIG. 3 shows a bottom view of the lock body 2 in accordance with FIGS. 1 and 2, with a further small bore 56 provided in the region of the bores 18 and with the screw 22 for the fixing the lock cylinder 20 being screwed through the small bore 56 into a threaded bore 59 (see FIG. 1) formed in the upper end face of the lock cylinder 20. FIG. 3 furthermore shows the lower end face of the ball pin 24 with its two engagement elements 28, 28'.

Figure 4:
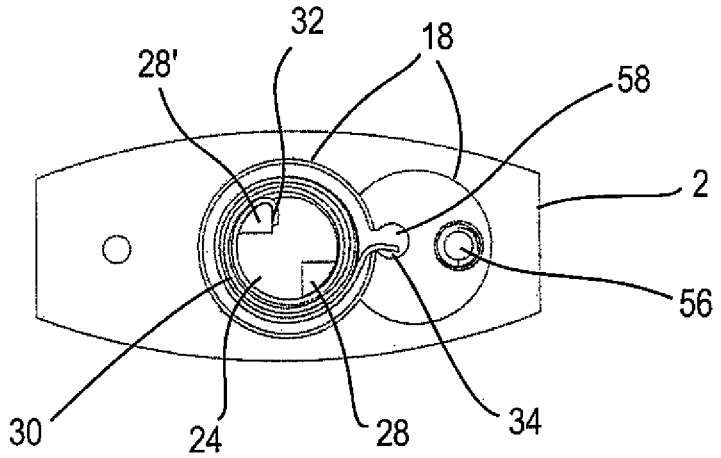
FIG. 4 is a view similar to FIG. 3 with the exception that the spring has been installed in the lock body.

If, in accordance with FIG. 4, the spiral spring 30 is introduced into the bores 18, care must be taken that the inner prolongation 32 of the spiral spring 30 is supported at the engagement element 28' so that a clockwise movement of the ball pin 24 produces an entrainment of the prolongation 32 by the engagement element 28'. The outer prolongation 34 of the spiral spring 30 is fixed in a corresponding groove 58 formed in the lock body 2 that is sized so that outer prolongation 34 can either not move at all or can only move slightly in the lock body 2.

Figure 5:
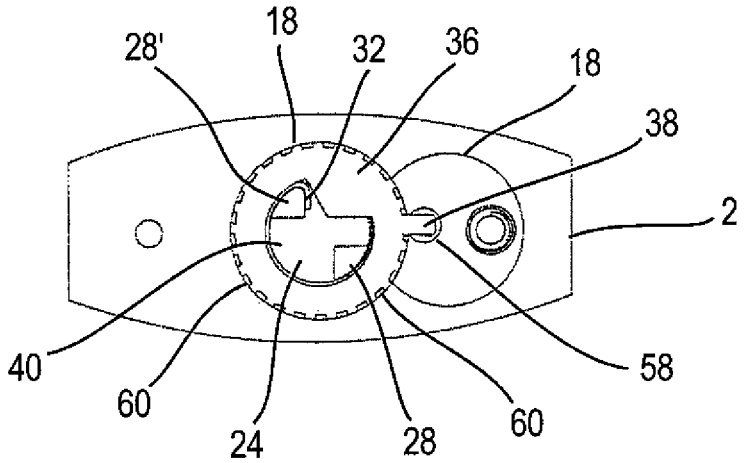
FIG. 5 is a view similar to FIG. 3 with the exception that the spring and the blocking plate have been installed in the lock body.

After insertion of the spiral spring 30, in accordance with FIG. 5, the blocking plate 36 is introduced into the bores 18. The blocking plate 36 in the embodiment in accordance with FIG. 5 has at its outer periphery a serrated or toothed arrangement 60 which enables a particularly good pressing of the blocking plate 36 into the bores 18. The opening 40 of the blocking plate is made as already explained in connection with FIGS. 1 and 2.

The radially projecting security against rotation tab 38 of the blocking plate 36 extends into the same groove 58 into which the outwardly projecting prolongation 34 of the spiral spring 30 was already introduced. Both rotation of the blocking plate 36 and rotation of the outer prolongation 34 of the spiral spring 30 relative to the lock body 2 is therefore reliably prevented by this engagement within the groove 58.

If subsequently, the lock cylinder 20 is now introduced into the bores 18—without the previous setting on of a bridge member 44—the entrainer formations 54, 54' and thus the entrainment member 52 move at least partly into the plane of the spiral spring 30 and the engagement elements 28, 28'. Since the engagement elements 28, 28' and the entrainer formations 54, 54' extending through the opening 40 lie at least partly in the same plane, they can abut one another upon rotational movement of the cylinder core 50 of the lock cylinder 20 so that a rotational movement of the cylinder core 50 can be transmitted to the ball pin 24.

Figure 6:
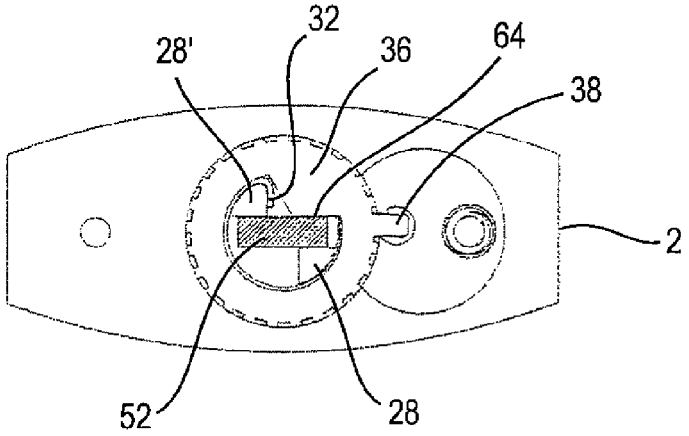
FIG. 6 is a view similar to FIG. 3 but showing the lock body having the spring, the blocking plate and an entrainment member of the lock cylinder core.

If the cylinder core 50 is located in its locked position whereat an introduced key can be withdrawn, the entrainment member 52 is located in its position shown in FIG. 6 such that the spiral spring 30 biases the engagement element 28', 28 on the ball pin 24 toward the entrainer formations 54, 54' on the entrainment member 52. In this position, in accordance with FIG. 7, the locking balls 16 are in engagement with an outer jacket surface of ball pin 24 and the grooves 14 of the shackle 10, whereby movement of the locking balls 16 out of the grooves 14 is blocked by the ball pin 24. Note that compression spring 12 is compressed by the end of shank 6. The padlock is thus reliably locked in this position.

Figure 8:
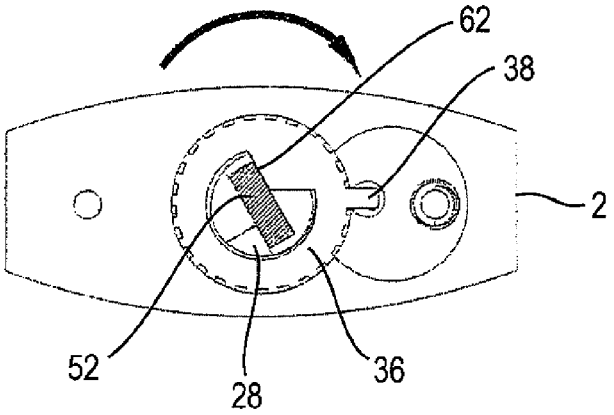
FIG. 8 is a view similar to FIG. 6 with the entrainment member of the lock cylinder core rotated.

If thereafter the cylinder core 50 is rotated by means of the key starting from the position shown in FIG. 6 in the direction of the arrow shown in FIG. 8, the entrainment member 52 accordingly also rotates and causes the entrainer formations 54, 54' to engage and rotate the corresponding engagement elements 28, 28' while increasing the bias of the spiral spring 30. The ball pin 24 is thus rotated about the same angular range as the cylinder core 50.

Figure 9:
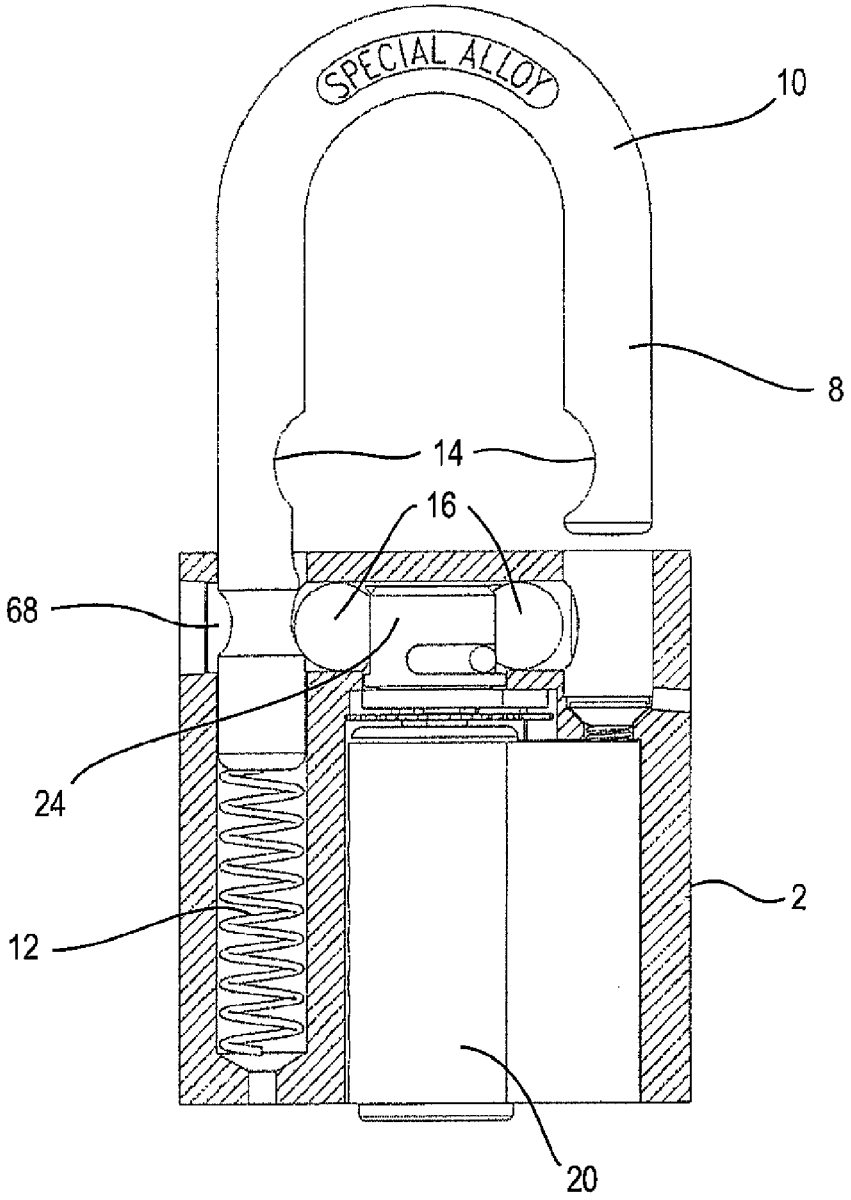
FIG. 9 is a partial sectional side view similar to FIG. 7 in which the padlock is shown in its open state.

As shown in FIG. 9, the mutually oppositely disposed grooves 26 in the ball pin 24 in this manner are rotated into the region of the locking balls 16, thereby enabling an inward movement of the locking balls 16 so that they can be moved out of the grooves 14 in the shackle 10. As a result, the compression spring 12 relaxes and moves the shank 8 of the shackle 10 completely out of the lock body 2. A region of the longer shank 6, however, remains in the lock body 2 since it is restricted in its axial movement by its corresponding locking ball 16 engaged with restriction 68.

In this opened position of the padlock, the entrainment member 52 abuts a first abutment surface 62 associated with region 42 of the blocking plate 36 so that the blocking plate ultimately restricts movement of the entrainment member 52 into its unlocked position. Likewise, a second abutment surface 64 associated with region 42 of blocking plate 36 (FIG. 6) ultimately restricts movement of the entrainment member 52 into its locked position in a corresponding manner.

Figure 10:
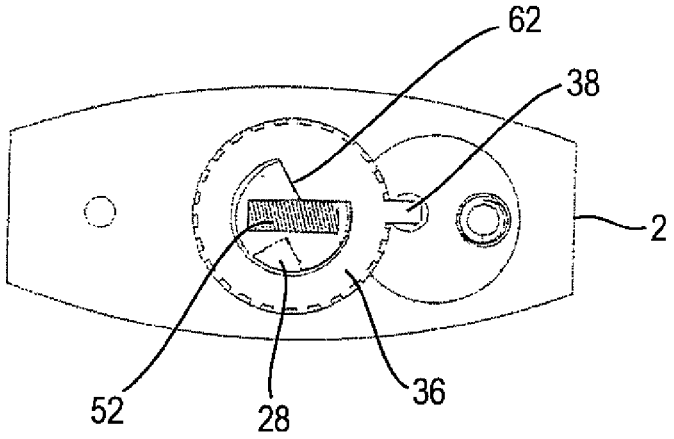
FIG. 10 is a view similar to FIG. 8 showing the entrainment member of the lock cylinder core rotated back to the position shown in FIG. 6.

FIG. 8 shows that there is an area of "play" between the entrainment member 52 or its entrainer formations 54, 54' and the engagement elements 28, 28' which makes it possible that the entrainment member 52 starting from the position shown in FIG. 8 can be rotated back into the position shown in FIG. 6 without the engagement elements 28, 28' or the ball pin 24 concurrently moving in this respect. This position is shown in FIG. 10. In this position, the padlock is still in its open state in accordance with FIG. 9, with it, however, being possible to withdraw the key from the lock cylinder core 20 since the cylinder core 50 is again in its locked position in accordance with FIGS. 6 and 7 independently of the ball pin 24.

Figure 7:
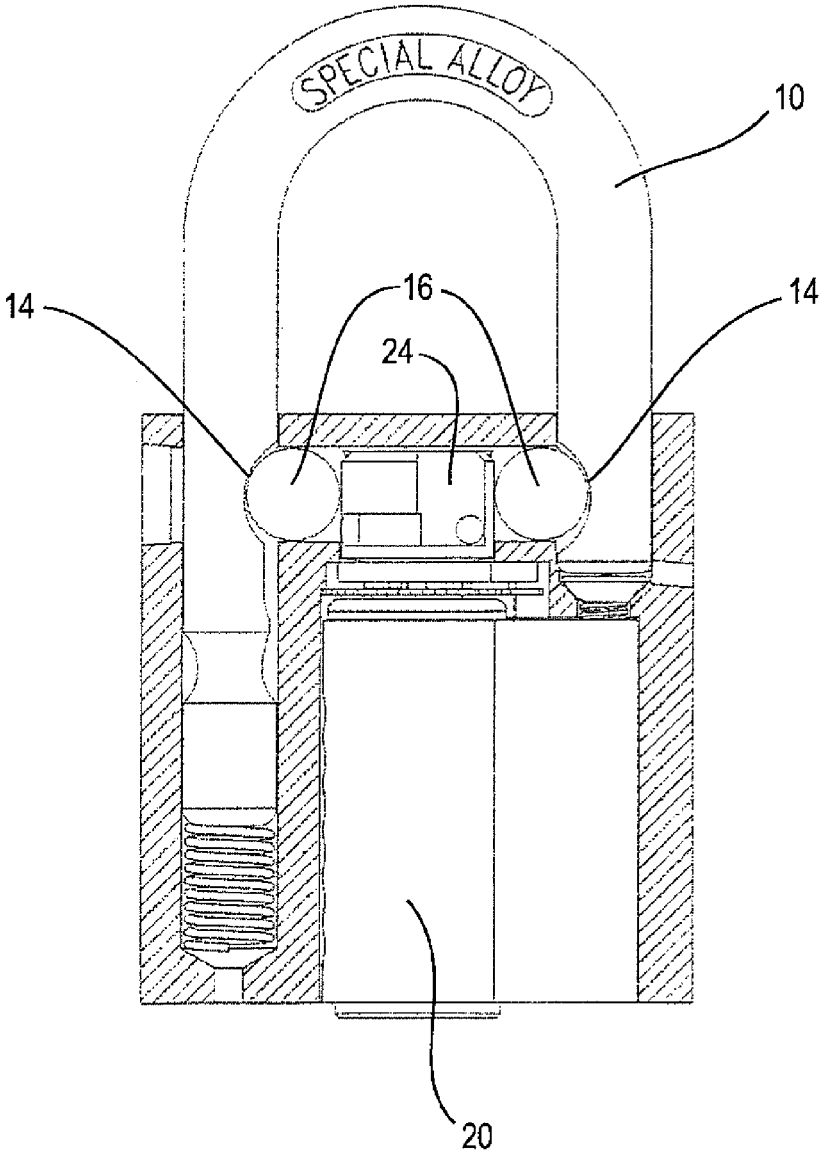
FIG. 7 is a partial sectional side view of a completely assembled padlock in accordance with FIGS. 1 and 2 in its locked state.

If now, starting from the positions FIG. 8 or FIG. 10, the shackle 10 is pressed into the lock body 2, the spiral spring 30 has the effect that the ball pin 24 rotates such that it moves into its position in accordance with FIGS. 6 and 7, with the locking balls 16 simultaneously being outwardly displaced into the grooves 14. In this position, the padlock is then again locked without there being any need for the conveying into this locked state of the key.

FIGS. 3 to 10 thus describe an automatic operation of the padlock in accordance with the invention. This automatic operation is realized since no bridge member 44 has been inserted into the plane of engagement elements 28, 28' or entrainer formations 54, 54'.

Figure 11:
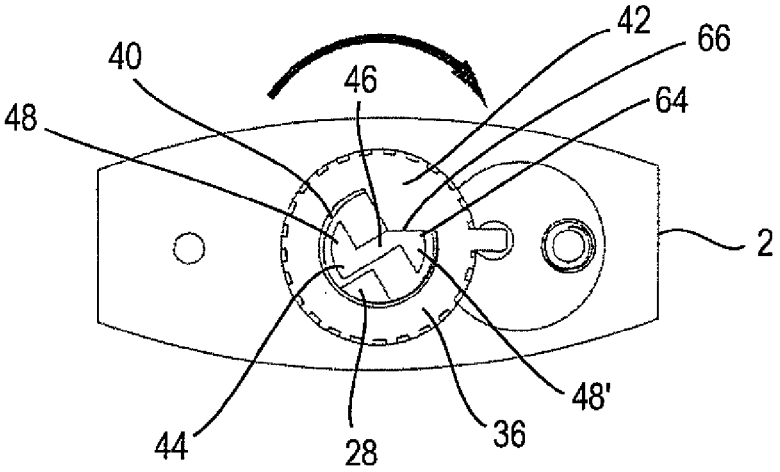
FIG. 11 is a view similar to FIGS. 8 and 10 without the entrainment member, but showing an insertable bridge member.

FIG. 11 now shows a situation in which the ball pin 24 is located in its unlocked position in accordance with FIG. 8 so that the opening 40 of the blocking plate 36 is reduced exclusively by the one engagement element 28 of the ball pin 24 since the other engagement element 28' is located behind the region 42 of the blocking plate 36. The opening 40 of the blocking plate 36 made smaller by the engagement element 28 is in this respect sufficiently large that the bridge member 44 can be moved through this opening 40 until it is located in the plane of the engagement elements 28, 28'. As already explained, the bridge member 44 has a center part 46 from which two shanks 48, 48' project at right angles. The two marginal regions of the shanks 48, 48' disposed outwardly with respect to the center part 46 have the shape of an arc of a circle, with the radius of these arcs being smaller than the radius of the opening 40 of the blocking plate 36. The center piece 46 has a chamfer 66 in the region of the shank 48' so that the bridge member 44 does not abut the abutment surface 64 of the blocking plate 36 on its insertion which, as a rule, occurs together with insertion of the lock cylinder 20.

After the lock cylinder 20 with the bridge member 44 located between its entrainer formations 54, 54' in accordance with FIG. 11 has been inserted in the open position of the padlock (FIG. 9), the lock cylinder 20 can be screwed to the lock body 2 via the screw 22. Since the coupling of the bridge member 44 to the lock cylinder 20 takes place before insertion of the lock cylinder 20, the entrainment member 52 moves into its position shown in FIG. 12 in which the entrainer formations 54, 54' come to lie at both sides of the center part 46 of the bridge member 44.

Figure 12:
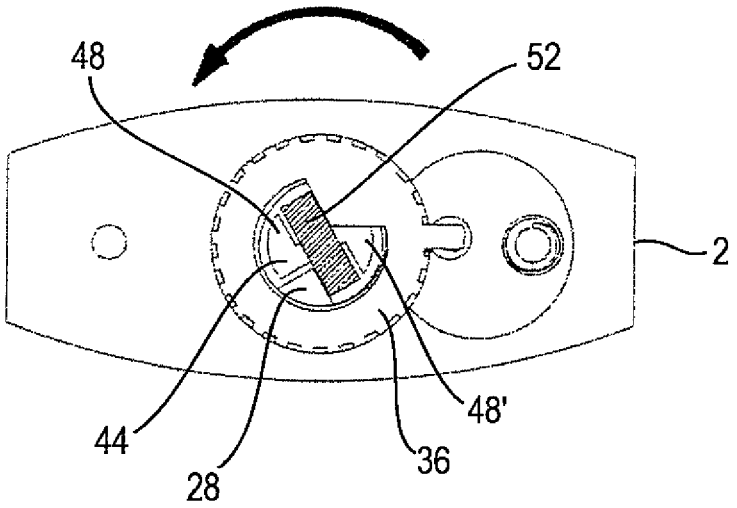
FIG. 12 is a view similar to FIG. 11 showing the entrainment member of the lock cylinder core.
Figure 13:
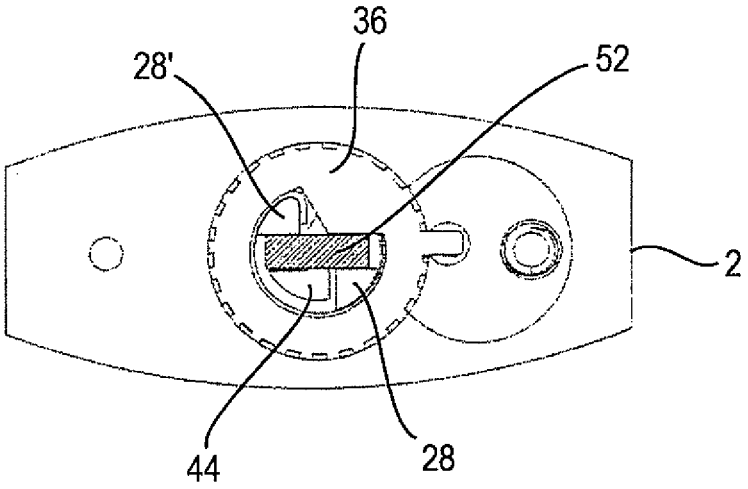
FIG. 13 is a view in accordance with FIG. 12 showing a rotated lock cylinder core.

FIG. 12 shows in a very illustrative manner that with a lock cylinder 20 inserted into the lock body 2, the two shanks 48, 48' of the bridge member 44 largely eliminate the play between the entrainment member 52 and the engagement elements 28, 28' so that the entrainment member 52 cannot be rotated in the direction of the arrow in accordance with FIG. 12 without in this respect entraining the engagement elements 28, 28' of the ball pin 24. In this respect, a rotation of the cylinder core 50 or of the entrainment member 52 in the direction of the arrow in accordance with FIG. 12 necessarily has the result that the ball pin 24 is also rotated into its locked position. Such a rotation is, however, only possible after the shackle 10 has been completely inserted into the lock body 2 so that a key can only be withdrawn from the cylinder core 50 when the padlock is actually locked. The position of the components shown in FIG. 12 after rotation in the direction of the arrow is shown in FIG. 13. Both the entrainment member 52 and the engagement elements 28, 28' and thus the ball pin 24 are located in their locked position in accordance with FIG. 13, which—as already mentioned—has the effect that the total padlock is in its locked position in accordance with FIG. 7.

Figure 14:
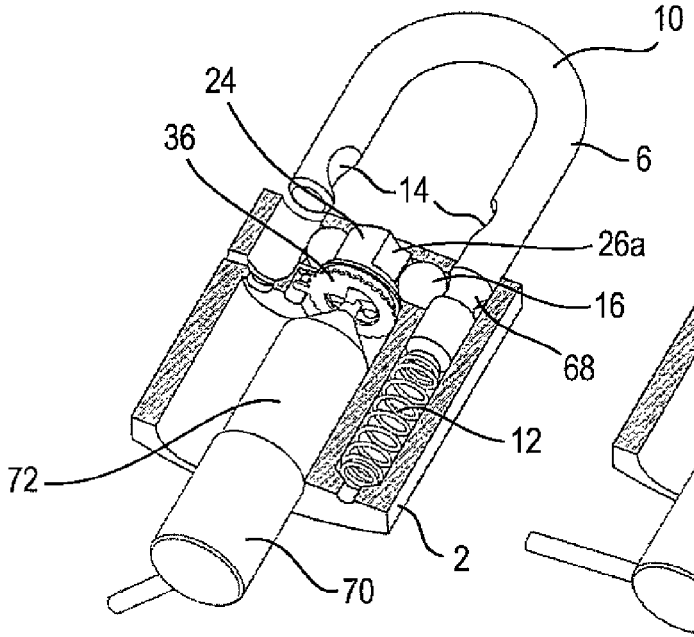
FIG. 14 is a freely sectioned view of a padlock in accordance with the invention with an introduced tool in a first position.

FIG. 14 shows the padlock in accordance with FIGS. 1 to 13 in a cut-away representation without the lock cylinder 20. In this respect, the ball pin 24 is in such a position that the locking balls 16 engage into the two mutually oppositely disposed grooves 26 (see FIG. 1) so that the locking balls 16 release the grooves 14 on the shanks 6, 8 of the shackle 10, which has the effect that the shackle 10 is moved out of the lock body 2 by the compression spring 12, as is shown in FIG. 14. The locking ball 16 at the right in FIG. 14 is in this respect in engagement with the restriction 68 of the longer shank 6 of the shackle 10 and thus prevents this longer shank 6 from being able to be completely released from the lock body 2.

The padlock in accordance with the invention is shown in FIG. 14 after the lock cylinder 20 (FIG. 1) has been removed from the lock body 2. Instead of the lock cylinder 20, a tool 70 is now introduced into the bores 18—the lock body 2 provided for the lock cylinder 20 in accordance with FIG. 14.

Figure 16:
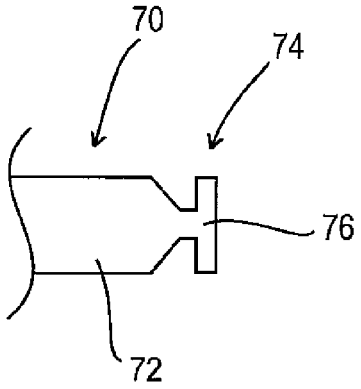
FIG. 16 is a schematic representation of a side view of the front region of the tool in accordance with FIGS. 14 and 15.

The front end region of the tool 70 is shown schematically in FIG. 16. It has a cylindrical section 72 whose diameter is dimensioned somewhat larger than the diameter of the lock cylinder core 50 (FIG. 1) so that this cylindrical section 72 is easily guided or supported in the lock body 2. The cylindrical section 72 tapers in its front end region and merges into a T-shaped section 74 which has a transverse shank 76 which extends transversely to the longitudinal axis of the tool 70.

This transverse shank 76 is conducted so far through the opening 40 of the blocking plate 36 in accordance with FIG. 14 until the end regions of the transverse shank 76 are in contact with the engagement elements 28, 28' of the ball pin 24. Starting from this position shown in FIG. 14, the tool 70 can be rotated clockwise so that the ball pin 24 co-executes this rotation and is "overrotated". This overrotation has the result that the deeper groove 26*a* (FIG. 1, FIG. 14) of the ball pin 24 moves into engagement with the locking ball 16 shown at the right in FIGS. 14 and 15. As FIG. 15 shows, this locking ball 16 can then move inwardly so far in the lock body 2 that it releases the restriction 68 so that the longer shank 6 of the shackle 10 can be completely moved past the locking ball 16 and can be removed from the lock body 2.

Figure 15:
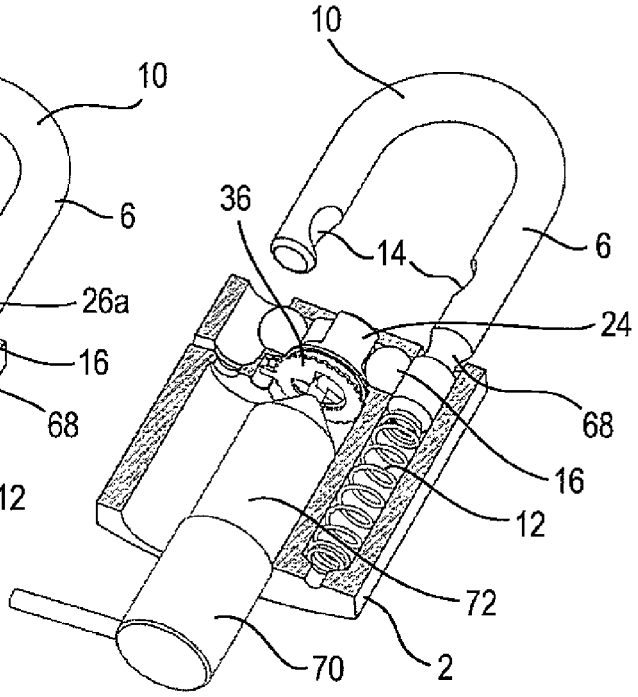
FIG. 15 is a view in accordance with FIG. 14 with the introduced tool in a second position.

In the tool position shown in FIG. 15, another shackle 10 can then be introduced as required into the lock body 2. If the tool is subsequently rotated back again counterclockwise into the position in accordance with FIG. 14, the locking ball 16 shown at the right in FIG. 14 or 15 in turn prevents, due to a restriction 68 also present in the new shackle, said shackle from being released unintentionally from the lock body 2.

FIGS. 1 to 15 thus show a padlock in accordance with the invention which simultaneously permits both a replacement of the shackle and a switch between an automatic operation and forced locking and in this respect provides the advantages in accordance with the invention.

REFERENCE NUMERAL LIST

2 lock body
4 bores
6 shank
8 shank
10 shackle
12 compression spring
14 groove
16 locking ball
18 bores
20 lock cylinder
22 screw
24 ball pin
26 grooves
26*a* deeper groove
28, 28' engagement element
30 spiral spring
32 prolongation
34 prolongation
36 blocking plate
38 security against rotation
40 opening
42 region
44 bridge member
46 center part
48, 48' shank
50 cylinder core
52 entrainment member
54, 54' entrainer formation
56 bore
58 groove
59 thread
60 toothed arrangement
62 abutment surface
64 abutment surface
66 chamfer
68 restriction
70 tool
72 cylindrical tool section
74 front end region
76 transverse shank The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A padlock comprising:

a lock body;

a shackle with two shanks each having a groove for the reception of a part region of a corresponding locking element;

a pin operable to be acted on by a lock cylinder core to make a rotational movement for moving the locking elements into a locked position, the pin having a jacket surface that includes a pair of oppositely disposed grooves as well as another groove having a depth greater than the pair of oppositely disposed grooves, and at least one engagement element configured to cooperate with at least one entrainer formation of the lock cylinder core;

a spring biasing the pin into the locked position;

a blocking plate located between the pin and the lock cylinder core that is fastened in the lock body and has an opening through which the entrainer formation of the lock cylinder core projects into a plane of the engagement element, with the opening being configured such that rotational movement of the lock cylinder core is possible and such that a marginal region of the opening forms an abutment that is engageable with the entrainer formation for restricting rotational movement of the lock cylinder core; and a selectively removable bridge member inserted between the engagement element and the entrainer formation, the bridge member operable to be inserted through the opening in the blocking plate into the plane of the engagement element;

wherein the pin is arranged entirely outside a plane defined by the blocking plate, a core play exists between the engagement element and the entrainer formation that allows rotation of the lock cylinder core about a specific angle without the pin co-rotating, and the bridge member, when selectively inserted between the engagement element and the entrainer formation, eliminates the play.

2. The padlock in accordance with claim 1, wherein a first marginal region of the opening in the blocking plate forms another abutment engageable with the entrainer formation for restricting rotational movement of the lock cylinder core into an open position.

3. The padlock in accordance with claim 1, wherein the lock cylinder core has first and second entrainer formations that are arranged off-center on an end face facing the pin and that are oppositely disposed with respect to an axis of rotation of the lock cylinder core.

4. The padlock in accordance with claim 3, wherein the first and second entrainer formations each have a substantially rectangular cross-section.

5. The padlock in accordance with claim 3, wherein the first marginal region of the opening in the blocking plate forms a first abutment engageable with the first entrainer formation for restricting rotational movement of the lock cylinder core into an open position, and wherein a second marginal region of the opening in the blocking plate forms a second abutment engageable with the second entrainer formation for restricting rotational movement of the lock cylinder core into the locked position.

6. The padlock in accordance with claim 1, wherein the pin has first and second engagement elements which are arranged off-center on an end face of the pin facing the lock cylinder and which are oppositely disposed with respect to the axis of rotation of the pin.

7. The padlock in accordance with claim 6, wherein the first and second engagement elements each have a cross-section of substantially quadrant shape.

8. The padlock in accordance with claim 1, wherein the blocking plate is pressed into the lock body.

9. The padlock in accordance with claim 1, wherein the blocking plate has a circular shape with a diameter that corresponds to a diameter of a region of a lock cylinder that includes the lock cylinder core.

10. The padlock in accordance with claim 1, wherein the blocking plate includes an outer periphery having elevated portions and recesses in an alternating fashion in at least a part thereof.

11. The padlock in accordance with claim 1, wherein the blocking plate includes an outer periphery having a security against rotation member projecting radially therefrom.

12. The padlock in accordance with claim 1, wherein the opening in the blocking plate approximately has the shape of a part circle, with the part circle including an angle between 180° and 300°.

13. The padlock in accordance with claim 1, wherein the shanks of the shackle have different lengths, and the shank having a greater length has a restriction at an end region that faces the lock body.

14. The padlock in accordance with claim 1, wherein the bridge member has a Z shape with a center part and two shanks projecting therefrom at an angle.

15. The padlock in accordance with claim 14, wherein marginal regions of the shanks of the bridge member are outwardly disposed with respect to the center part and have the shape of an arc of a circle, with a radius of these arcs being smaller than the radius of the opening of a part circle portion of the blocking plate.

16. The padlock in accordance with claim 1, wherein a center part has a chamfer in the region of only one of the two shanks which is provided on the side of the center part remote from the respective shank.

17. A padlock comprising:

a lock body;

a shackle with two shanks each having a groove for receipt of a respective part region of a locking element;

a pin configured to be acted on by a lock cylinder core to make a rotational movement for moving the locking elements into a locked position, the pin being biased into the locked position by a spring, and the pin having at least one engagement element configured to cooperate with at least one entrainer formation on the lock cylinder core;

a blocking plate provided between the pin and the lock cylinder core fastened in the lock body and having an opening through which the entrainer formation of the lock cylinder core projects into a plane of the engagement element, with the opening being configured such that a rotational movement of the lock cylinder core is possible and such that a marginal region of the opening forms an abutment engageable with the entrainer formation for restricting rotational movement of the lock cylinder core; and a selectively removable bridge member inserted between the engagement element and the entrainer formation, the bridge member operable to be inserted through the opening in the blocking plate into the plane of the engagement element;

wherein the pin is arranged entirely outside a plane defined by the blocking plate and has, at jacket surface thereof, a pair of oppositely disposed grooves and another groove having a depth greater than a depth of the pair of oppositely disposed grooves, and wherein a core play is present between the engagement element and the entrainer formation that allows rotation of the lock cylinder core about a specific angle without the pin co-rotating, and the bridge member, when selectively inserted between the engagement element and the entrainer formation, eliminates the play.

18. The padlock in accordance with claim 17, further including a tool having a T shape in a front end region with the length of a transverse shank of the T shape being dimensioned such that the transverse shank is movable through the opening of the blocking plate, and wherein the dimensions of the transverse shank in a direction of an axis of rotation of the cylinder core corresponding approximately to a height of at least one of the engagement elements of the pin wherein a connection section between the transverse shank and a remaining tool region is dimensioned such that this connection section is rotatable within the opening of the blocking plate.

19. The padlock in accordance with claim 18, wherein a cylindrical region whose diameter is dimensioned larger than a diameter of the cylinder core adjoins the front end region.

* * * * *